US008360202B1

(12) United States Patent
Woodard

(10) Patent No.: US 8,360,202 B1
(45) Date of Patent: Jan. 29, 2013

(54) PERSONNEL EXTRACTION SYSTEM

(76) Inventor: Addison L. Woodard, Oklahoma City, OK (US)

( * ) Notice: Subject to any disclaimer, the term of this patent is extended or adjusted under 35 U.S.C. 154(b) by 414 days.

(21) Appl. No.: 12/415,892

(22) Filed: Mar. 31, 2009

Related U.S. Application Data

(60) Provisional application No. 61/040,962, filed on Mar. 31, 2008.

(51) Int. Cl.
*A62B 1/16* (2006.01)

(52) U.S. Cl. ..... 182/3; 182/4; 182/70

(58) Field of Classification Search ..... 182/230, 182/3–6, 70; 119/857, 863, 725, 792, 770, 119/769, 795, 797, 798; 224/184; 24/115 R, 24/16 R, 17 R, 17 A, 68 R, 68 FP
See application file for complete search history.

(56) References Cited

U.S. PATENT DOCUMENTS

| | | | | |
|---|---|---|---|---|
| 2,699,284 | A | 1/1955 | Rose | |
| 3,074,074 | A | 1/1963 | Lovering | |
| 4,480,716 | A * | 11/1984 | Soubry et al. | 182/233 |
| 4,854,418 | A | 8/1989 | Hengstenberger et al. | |
| 4,863,409 | A | 9/1989 | Johnson et al. | |
| 4,925,070 | A | 5/1990 | Tulgan | |
| 4,937,920 | A * | 7/1990 | Tsai | 24/3.3 |
| 5,090,503 | A * | 2/1992 | Bell | 182/5 |
| 5,094,405 | A * | 3/1992 | Brum | 244/1 TD |
| 5,113,981 | A | 5/1992 | Lantz | |
| 5,174,410 | A * | 12/1992 | Casebolt | 182/3 |
| 5,388,551 | A | 2/1995 | Martusciello | |
| 5,435,272 | A | 7/1995 | Epstein | |
| 5,619,955 | A | 4/1997 | Nelson | |
| 5,738,046 | A * | 4/1998 | Williams et al. | 119/770 |
| 5,787,500 | A | 8/1998 | Lobello | |
| 5,839,932 | A * | 11/1998 | Pierce et al. | 441/80 |
| 5,950,569 | A * | 9/1999 | Perrulli | 119/770 |
| 5,960,480 | A * | 10/1999 | Neustater et al. | 2/456 |
| 6,125,792 | A | 10/2000 | Gee | |
| 6,134,713 | A * | 10/2000 | De Rosa et al. | 2/94 |
| 6,205,584 | B1 | 3/2001 | Yocco | |
| 6,256,789 | B1 | 7/2001 | Young et al. | |
| 6,275,994 | B1 * | 8/2001 | Lewis et al. | 2/94 |
| 6,305,024 | B1 | 10/2001 | Schweer | |
| 6,338,699 | B1 | 1/2002 | Veitch | |
| 6,533,066 | B1 * | 3/2003 | O'Dell | 182/3 |
| 6,637,547 | B1 | 10/2003 | Wydner | |
| 6,651,594 | B1 | 11/2003 | Bagwell | |

(Continued)

FOREIGN PATENT DOCUMENTS

JP 04212381 A * 8/1992

OTHER PUBLICATIONS

"Strap Wrap" Mar. 13, 2008. http://www.macscustomtiedowns.com/product/132/TieDowns (Accessed Sep. 6, 2011).*

(Continued)

*Primary Examiner* — Katherine W Mitchell
*Assistant Examiner* — Johnnie A Shablack
(74) *Attorney, Agent, or Firm* — Hall Estill Attorneys at Law; Daniel P. Dooley

(57) ABSTRACT

A personnel extraction system preferably includes at least a securement band and an extraction strap. Preferably, the extraction strap is affixed to the securement band and provides at least one attachment loop. The preferred embodiment includes the securement band being selectively configurable to provide the extraction strap in a storage state, an operative state, and a deployed state. In the deployment state, a first connecting hitch is secured to a rescue personnel while a second connection hitch is secured to a downed personnel and the extraction strap accommodates movement of the downed personnel to safety.

9 Claims, 8 Drawing Sheets

U.S. PATENT DOCUMENTS

| | | | | |
|---|---|---|---|---|
| 6,659,823 | B1 * | 12/2003 | Mosna et al. | 441/84 |
| 6,698,544 | B2 * | 3/2004 | Kurtgis | 182/3 |
| 6,732,834 | B2 * | 5/2004 | Colorado | 182/6 |
| D492,454 | S * | 6/2004 | Saunders | D30/153 |
| 6,763,554 | B1 * | 7/2004 | Torrey et al. | 24/30.5 P |
| 6,808,046 | B1 | 10/2004 | Henson | |
| 6,810,997 | B2 * | 11/2004 | Schreiber et al. | 182/238 |
| 6,892,395 | B2 | 5/2005 | Schweer | |
| 6,959,784 | B2 * | 11/2005 | Diggle et al. | 182/9 |
| 6,968,809 | B2 | 11/2005 | Reardon | |
| 6,990,928 | B2 * | 1/2006 | Kurtgis | 119/770 |
| 7,007,322 | B2 * | 3/2006 | Alane | 5/417 |
| 7,014,594 | B2 * | 3/2006 | Stoltz | 482/24 |
| 7,086,091 | B2 | 8/2006 | Jordan | |
| 7,165,294 | B2 * | 1/2007 | Surdam | 24/68 CD |
| 7,306,501 | B2 * | 12/2007 | Pierce et al. | 441/83 |
| 7,467,419 | B2 | 12/2008 | O'Neal et al. | |
| 7,516,717 | B2 * | 4/2009 | David et al. | 119/770 |
| 7,571,494 | B2 * | 8/2009 | Grilliot et al. | 2/69 |
| 7,585,197 | B1 * | 9/2009 | Merten | 441/80 |
| 7,909,137 | B2 * | 3/2011 | Green | 182/3 |
| 2002/0179372 | A1 * | 12/2002 | Schreiber et al. | 182/238 |
| 2005/0211188 | A1 | 9/2005 | Grilliot et al. | |
| 2005/0230184 | A1 * | 10/2005 | Ansaldo | 182/3 |
| 2005/0252717 | A1 * | 11/2005 | Farrah et al. | 182/3 |
| 2006/0076186 | A1 * | 4/2006 | Lindqvist | 182/70 |
| 2006/0217014 | A1 * | 9/2006 | Pierce et al. | 441/123 |
| 2007/0044197 | A1 | 3/2007 | Turcotte et al. | |
| 2007/0084667 | A1 * | 4/2007 | Waters et al. | 182/3 |
| 2007/0158139 | A1 * | 7/2007 | Moon et al. | 182/238 |
| 2008/0060872 | A1 * | 3/2008 | Wise | 182/3 |
| 2009/0025185 | A1 * | 1/2009 | Banes | 24/3.1 |
| 2009/0095232 | A1 * | 4/2009 | McKay | 119/770 |
| 2009/0127300 | A1 * | 5/2009 | Straight | 224/160 |
| 2010/0243372 | A1 * | 9/2010 | Wilkinson | 182/3 |
| 2011/0011504 | A1 * | 1/2011 | Steinbacher | 150/106 |
| 2011/0067953 | A1 * | 3/2011 | Kopp | 182/3 |
| 2011/0103558 | A1 * | 5/2011 | Hooten | 379/37 |
| 2011/0180015 | A1 * | 7/2011 | Larson | 119/792 |

OTHER PUBLICATIONS

"Webster Traditional Bowstringer" Sep. 10, 2007. http://www.abbeyarchery.com.au/p/AAD2449/Webster+Traditional+Bowstringer.html (Accessed Sep. 6, 2011).*

* cited by examiner

PERSONNEL EXTRACTION SYSTEM

RELATED APPLICATIONS

This application claims domestic priority to U.S. Provisional Application No. 61/040,962 filed Mar. 31, 2008, entitled "Personnel Extraction System."

FIELD OF THE INVENTION

The present invention relates generally to the field of rescue equipment, but not by way of limitation, to the extraction of injured personnel.

BACKGROUND OF THE INVENTION

The ability to safely and efficiently rescue downed personnel has been a continued goal of the military and emergency services such as firefighters and medical technicians.

Often during the rescue of downed personnel, a tether of considerable length is needed. Likewise, the use of a second hand during rescue is required for equipment such as a gun or medical device. In the past, rescue tethers have been loose, bulky, and inefficient for rescues where time and space are at a premium. The use of rope or other braided strand usually was wrapped around downed personnel and secured with a knot. This procedure is grossly inefficient during a rescue due to the time and two hand requirement of tying and untying knots. Similarly, knots are traditionally weak points in a tether that come undone resulting in safety hazard for the personnel. The historical problem of inefficient and unsafe rescue tethers has mandated innovation. Therefore, a tether that is efficiently deployed and increases the safety of both rescuer and rescued is needed.

Many attempts have been made to provide a rescue tether that is efficient and safe for a wide variety of emergency situations. However, none of the rescue tethers currently available combine the ability to single-handedly operate and deploy a tether with a compact secure storage mode that allows for efficient transport. A tether including a handle has been invented, but the tether does not deploy nor does it have an easily transportable storage mode where the tether is secure. Likewise, a tether exists that has multiple attachment points. This tether fails to provide a quickly operational yet compact design that allows the user to deploy the tether at a selected rate. Therefore, attempts have been made to provide rescue tethers that are capable of efficient use in emergency situations, but have failed to provide an appliance that has multiple modes that is simple and efficient to operate.

Accordingly, there is a continuing need for improved rescue equipment that extracts personnel from an emergency situation.

SUMMARY OF THE INVENTION

In accordance with the preferred embodiments, a personnel extraction system is provided that includes at least a securement band. The securement band is preferably affixed to an extraction strap. In a preferred embodiment, the extraction strap includes at least one attachment loop. The securement band is configured to provide the extraction strap in a storage state, an operative state, and a deployed state.

These and various other features and advantages which characterize the claimed invention will be apparent from reading the following detailed description and a review of the associated drawings.

DETAILED DESCRIPTION OF THE INVENTION

Figure 1:
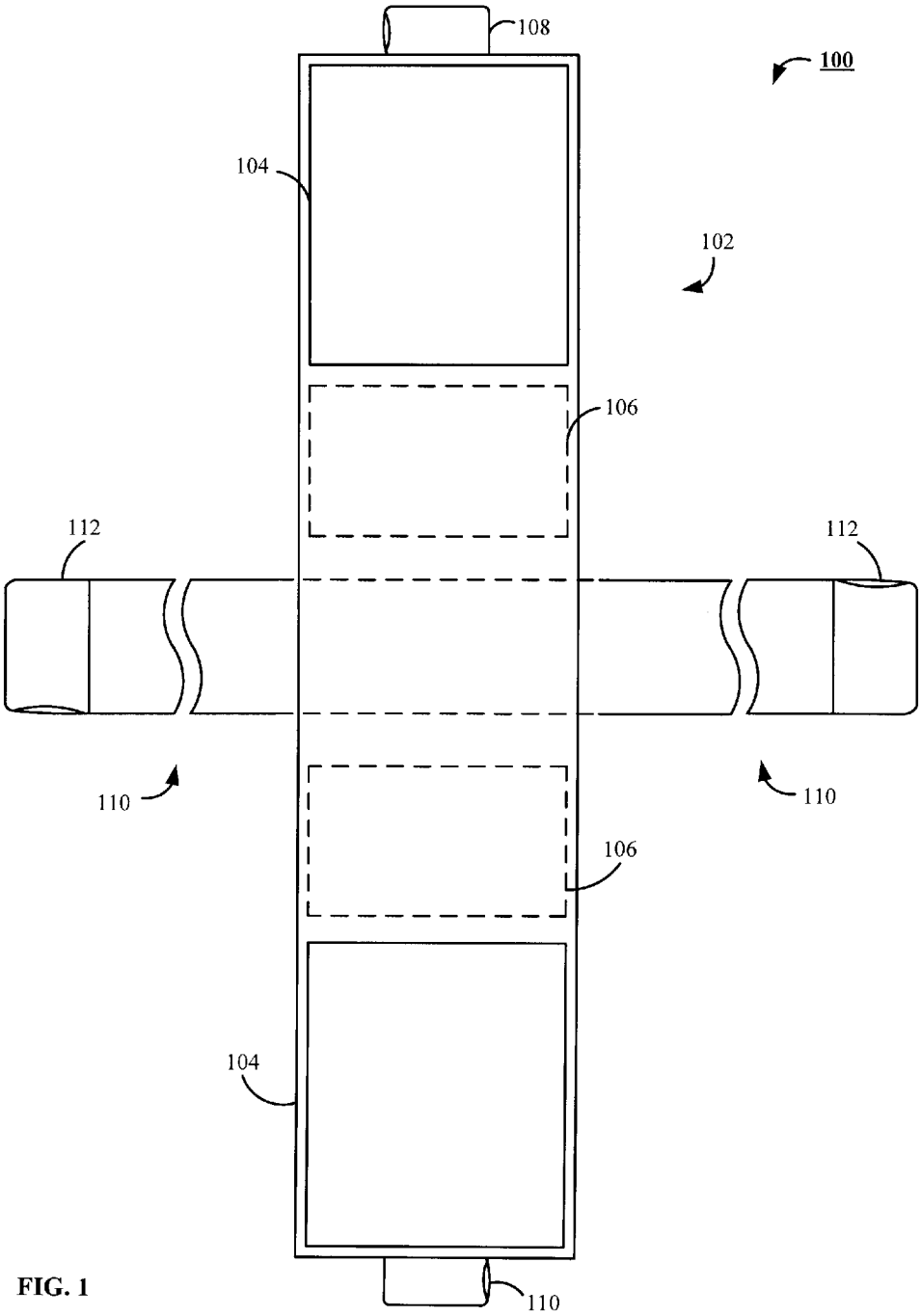
FIG. 1 is a top plan view of the personnel extraction system.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify steps of a method or process is simply for identification and is not meant to indicate that the steps should be performed in a particular order. Other modifications and variations to the described embodiments are also contemplated within the scope and spirit of the invention.

Preferred embodiments of the present invention are generally directed to a personnel extraction system configured to provide safe and efficient extraction of downed personnel in emergency situations, such as military combat and natural disasters.

FIG. 1 shows a top plan view of the personnel extraction system 100. The personnel extraction system 100 preferably includes a securement band 102 with a first fastening means 104 and a second fastening means 106. The securement band 102 further preferably includes a release tab 108 to aid in the connection of the first and second fastening means 104 and 106. In a preferred embodiment, the securement band 102 is affixed to an extraction strap 110. The extraction strap 110 preferably includes at least one attachment loop 112.

Figure 2:
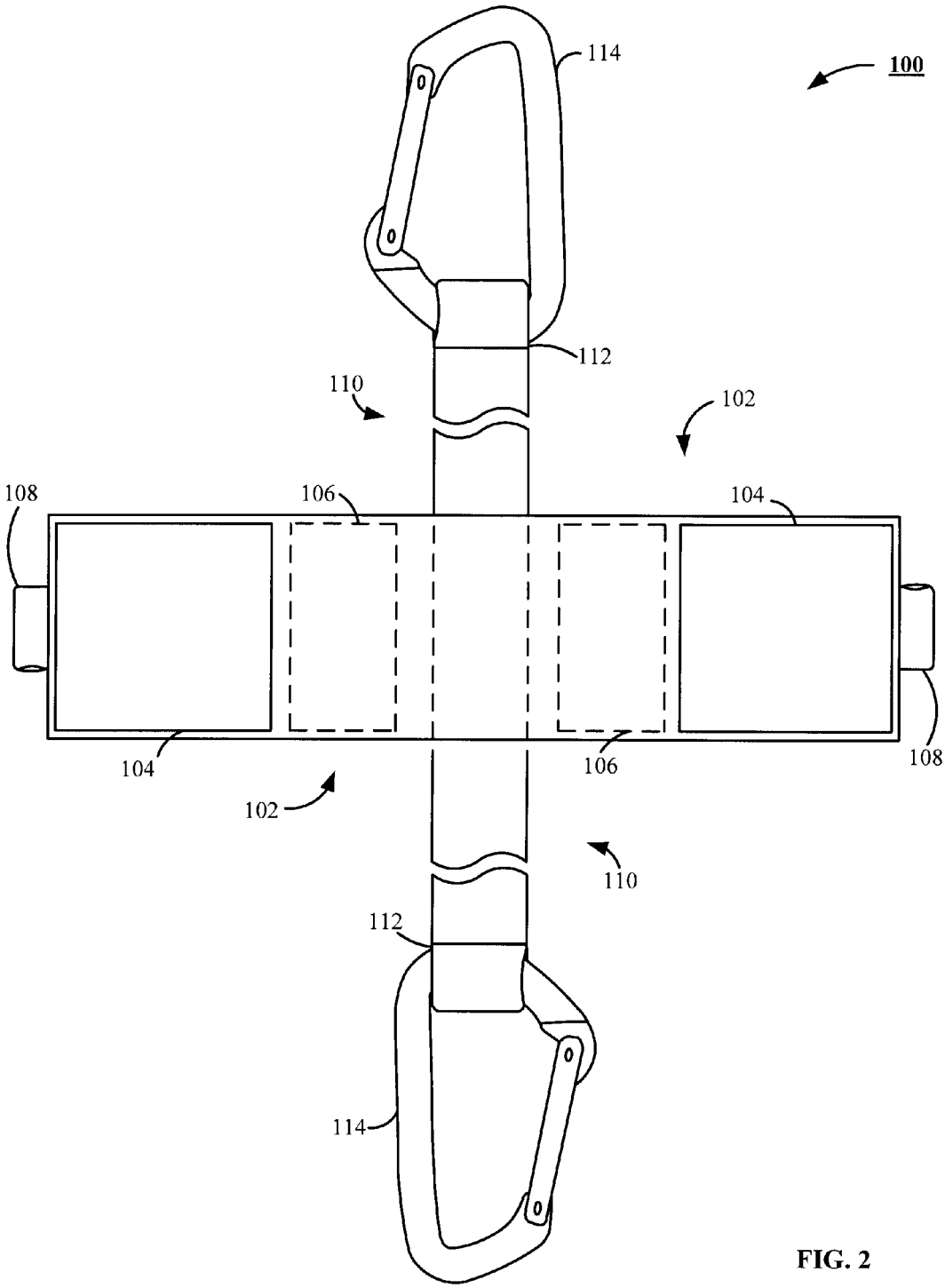
FIG. 2 is a top plan view of the personnel extraction system.

FIG. 2 displays a top plan view of the personnel extraction system. The personnel extraction system 100 includes a securement band 102 to which a first fastening means 104, a second fastening means 106, and a release tab 108 are preferably included. The fastening means can preferably include a variety of fasteners including hook and loop, snap button, and magnetic. Further in a preferred embodiment, the securement band 102 is affixed to an extraction strap 110. At least one attachment loop 112 is preferably included in the extraction strap 110. Preferably, the attachment loops 112 have a connection hitch 114 linked. The connection hitch 114 allows secure joining of the personnel extraction system 100 to a downed person. In the preferred embodiment, connection hitch 114 is a carabiner, such as the ISO COLD FORGED D model by Omega Pacific of Airway Heights, Wash.

Figure 3:
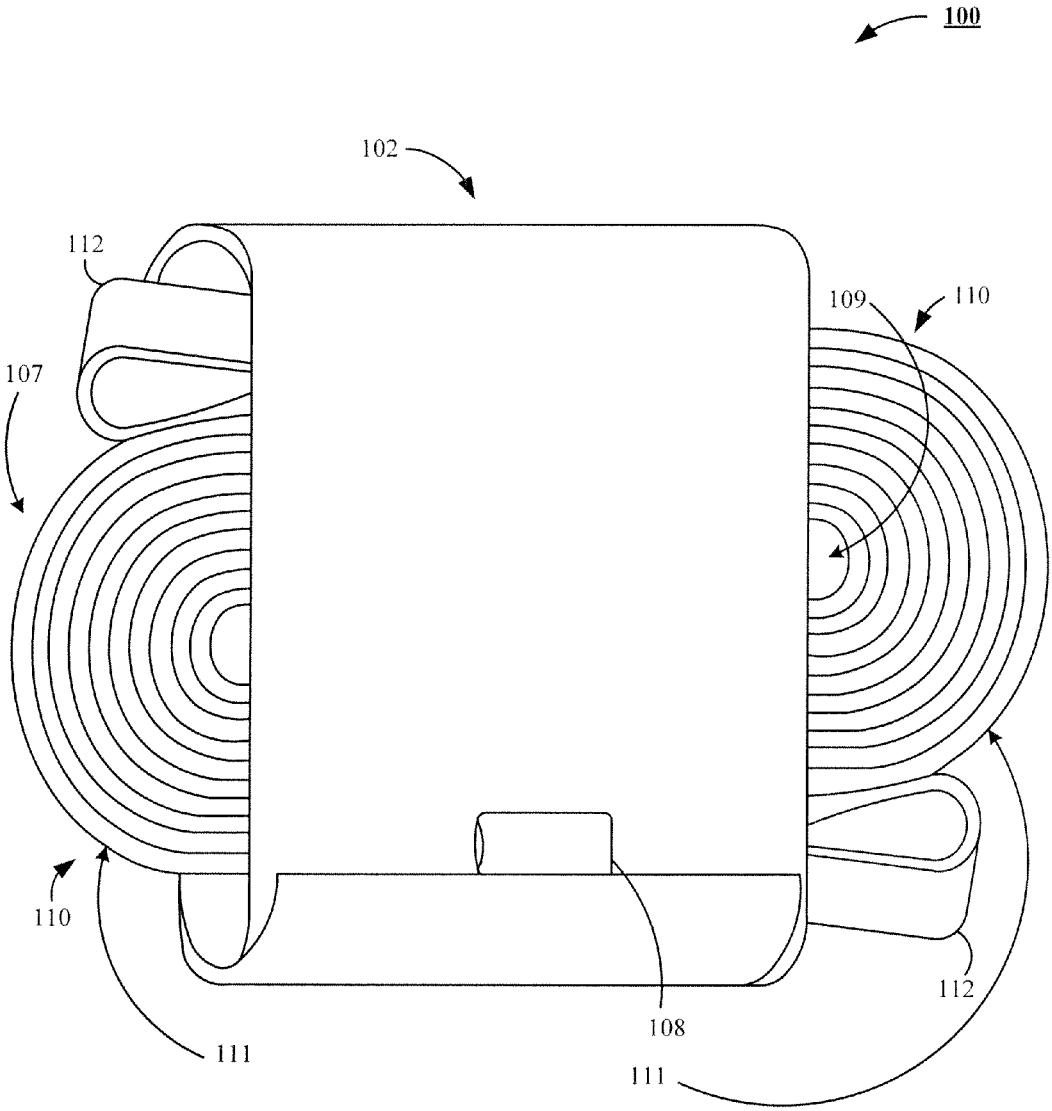
FIG. 3 is a side plan view of the personnel extraction system in a preferred embodiment.

The illustration of FIG. 3 shows a side plan view of the personnel extraction system in a preferred embodiment. A securement band 102 surrounds the extraction strap 110 through the connection of the first and second fastening means 104 and 106. The securement band preferably presents the release tab 108 for efficient engagement of the first and second fastening means 104 and 106 of FIG. 1 of the securement band 102. In a preferred embodiment, the extraction strap 110 is wrapped around a central point of the securement band 102 to form a coiled extraction strap 107, which includes a central portion 109 confined within the confines of the securement band 102, and anon-central portion 111, which extends beyond the confines of the securement band 102. As shown in FIG. 3, the securement band 102 may enclose only the central portion 109 of the coiled extraction strap 107. The coiled extraction strap 107 decreases the overall size of the personnel extraction system 100 and allows for easy control for a user. Further, the preferred embodiment includes at least one attachment loop 112 on the extraction strap.

Figure 4:
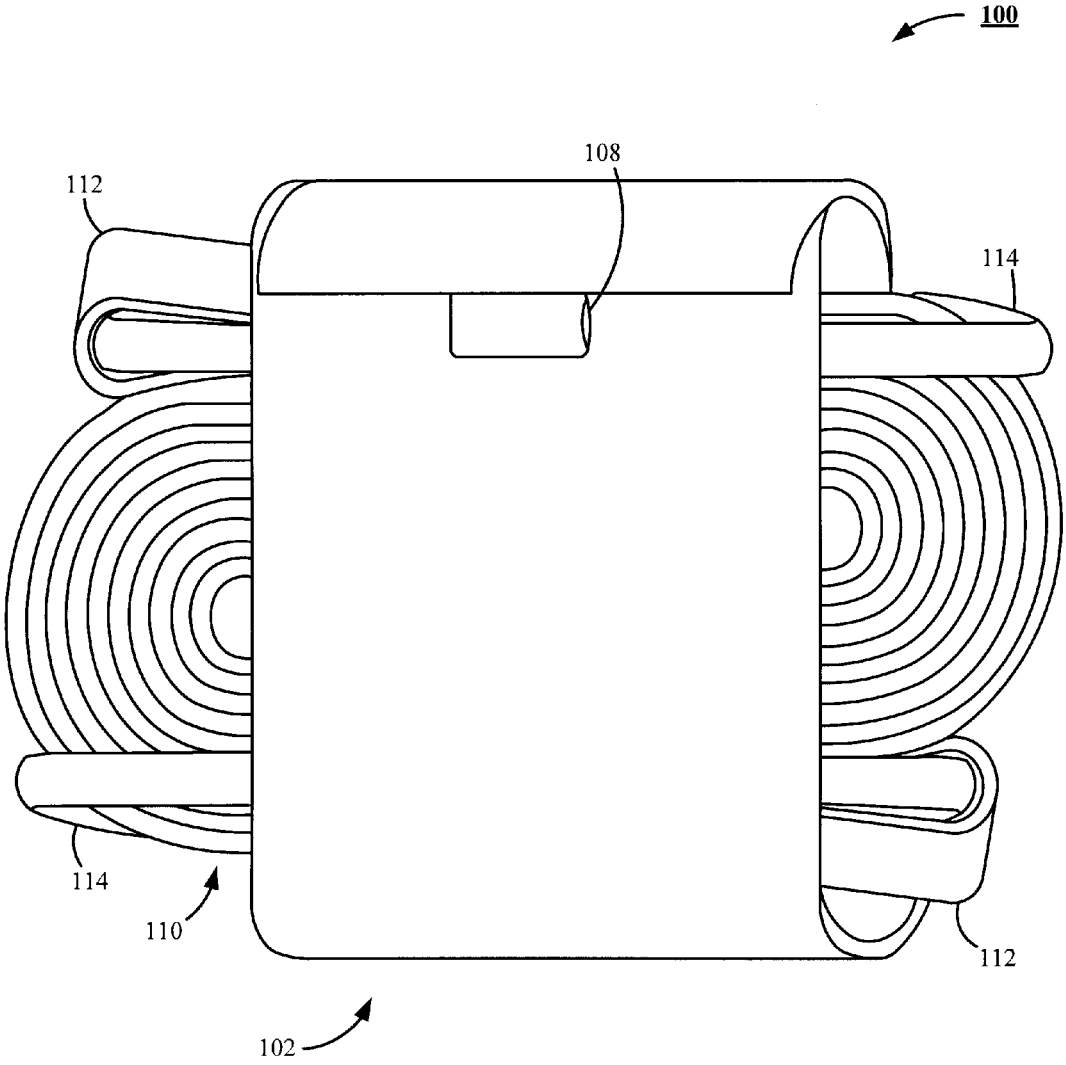
FIG. 4 is a side view of the personnel extraction system in a preferred embodiment.

The side view of a preferred embodiment of the personnel extraction system 100 is displayed in FIG. 4. The securement band 102 is preferably shown surrounding the extraction strap 110 through the connection of the first and second fastening means of FIG. 1. The extraction strap 110 preferably includes at least one attachment loop 112 to which a connection hitch 114 is linked to each loop. The connection hitch 114 can be positioned under the securement band 102 to provide the extraction strap 110 in a storage state. The storage state prevents a user from accidentally deploying the extraction strap 110 due to the placement of the hitch 114.

Figure 5:
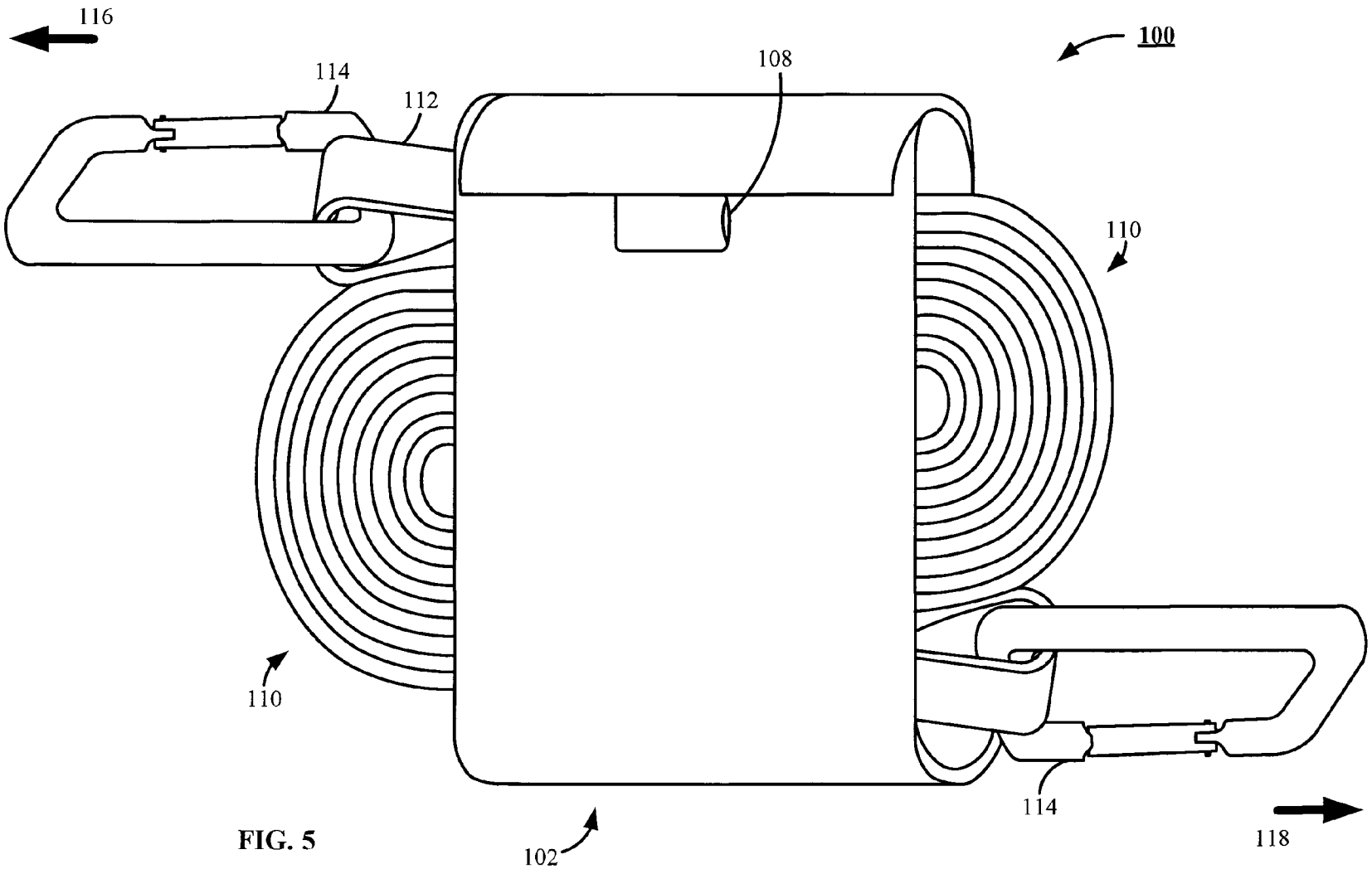
FIG. 5 is a side view of the personnel extraction system in a preferred embodiment.

FIG. 5 displays a side view of the personnel extraction system 100 in a preferred embodiment. A securement band 102 is preferably provided surrounding the extraction strap 110 through the connection of the first and second fastening means 104 and 106 of FIG. 1. The preferred position of the securement band 102 provides the release tab 108 in a convenient position to allow a user access to the extraction strap 110. In a preferred embodiment, the extraction strap 110 includes at least one attachment loop 112 to which a connection hitch 114 is linked. The placement of the connection hitch 114 outside of the securement band 102 while it is secured around the extraction strap 110 provides the extraction strap 110 in an operational state. The operational state preferably includes forces 116 and 118 that are selectively controlled by the user to allow deployment of the extraction strap 110 at a selected rate.

Figure 6:
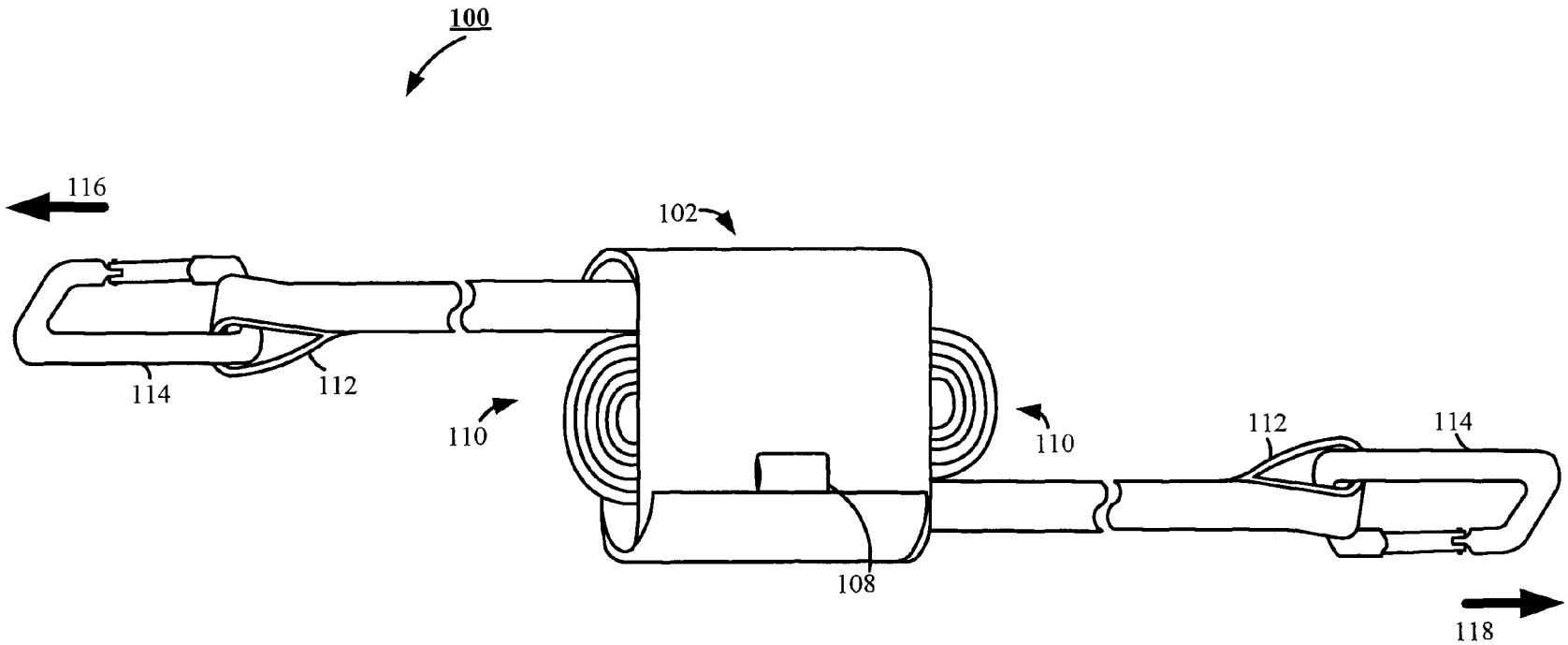
FIG. 6 is a side view of the personnel extraction system in a preferred embodiment.

The illustration of FIG. 6 shows a side view of the personnel extraction system 100 in a preferred embodiment. The securement band 102 preferably surrounds the extraction strap 110 through the connection of the first and second fastening means 104 and 106 of FIG. 1. In a preferred embodiment, the securement band 102 presents a release tab 108 in a position efficient for the user to control. The extraction strap 110 preferably deploys as forces 116 and 118 move in opposite directions. Further in a preferred embodiment, the extraction strap 110 deploys while the securement band 102 continues to surround the remaining coiled portion of the extraction strap 110. As the connection hitch 114 is preferably pulled through forces 116 and 118, the extraction strap 110 deploys by uncoiling from under the securement band 102. Preferably, the securement band 102 remains connected around the extraction strap 110 until the strap is fully deployed.

Figure 7:
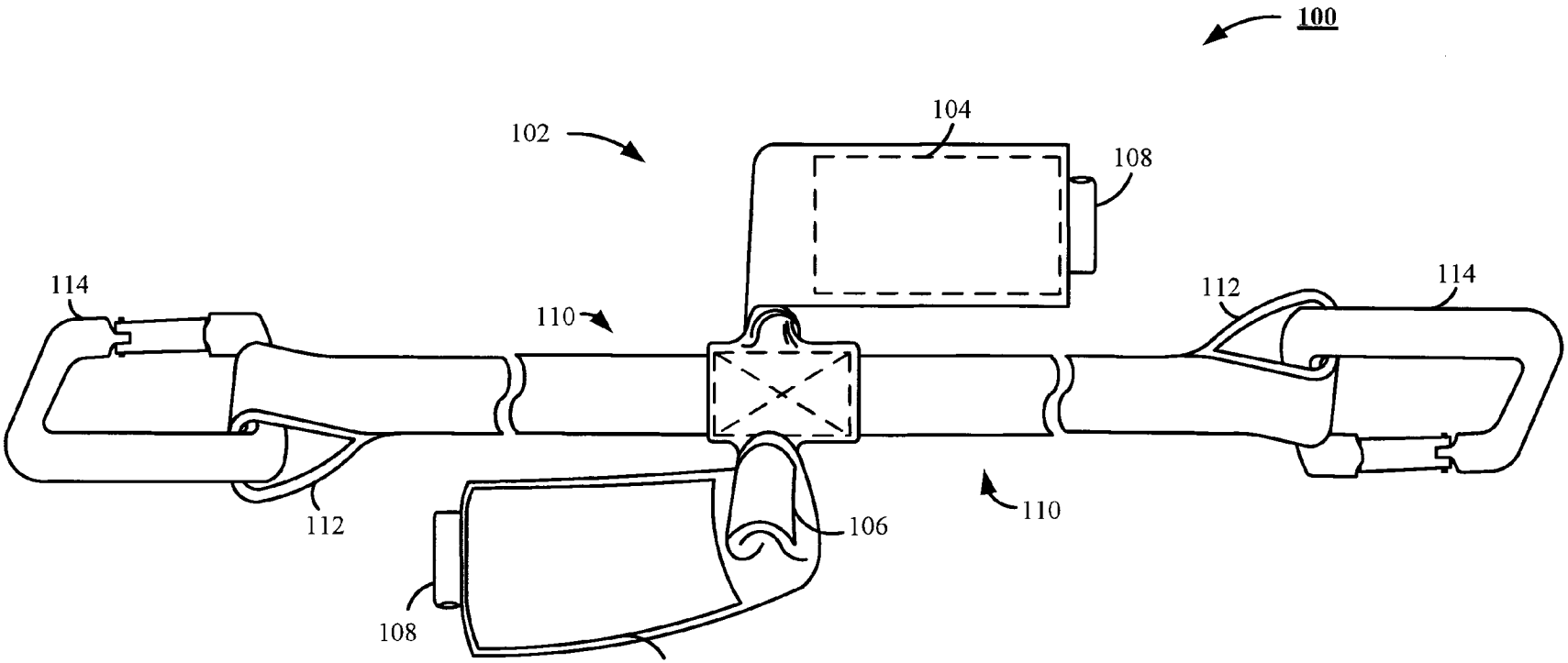
FIG. 7 is a top plan view of the personnel extraction system after deployment in a preferred embodiment.

The illustration of FIG. 7 shows a top plan view of the personnel extraction system 100 after deployment in a preferred embodiment. The securement band 102 is twisted due to the uncoiling of the extraction strap 110. The securement band 102 preferably includes a first and second fastening means 104 and 106 as well as a release tab 108. In a preferred embodiment, the extraction strap 110 includes at least one attachment loop 112 to which a connection hitch 114 is linked. The preferred embodiment further includes the position of the first and second fastening means 104 and 106 to allow the securement band 102 to connect to itself, and remains outside the direct path of the extraction strap 110.

Figure 8:
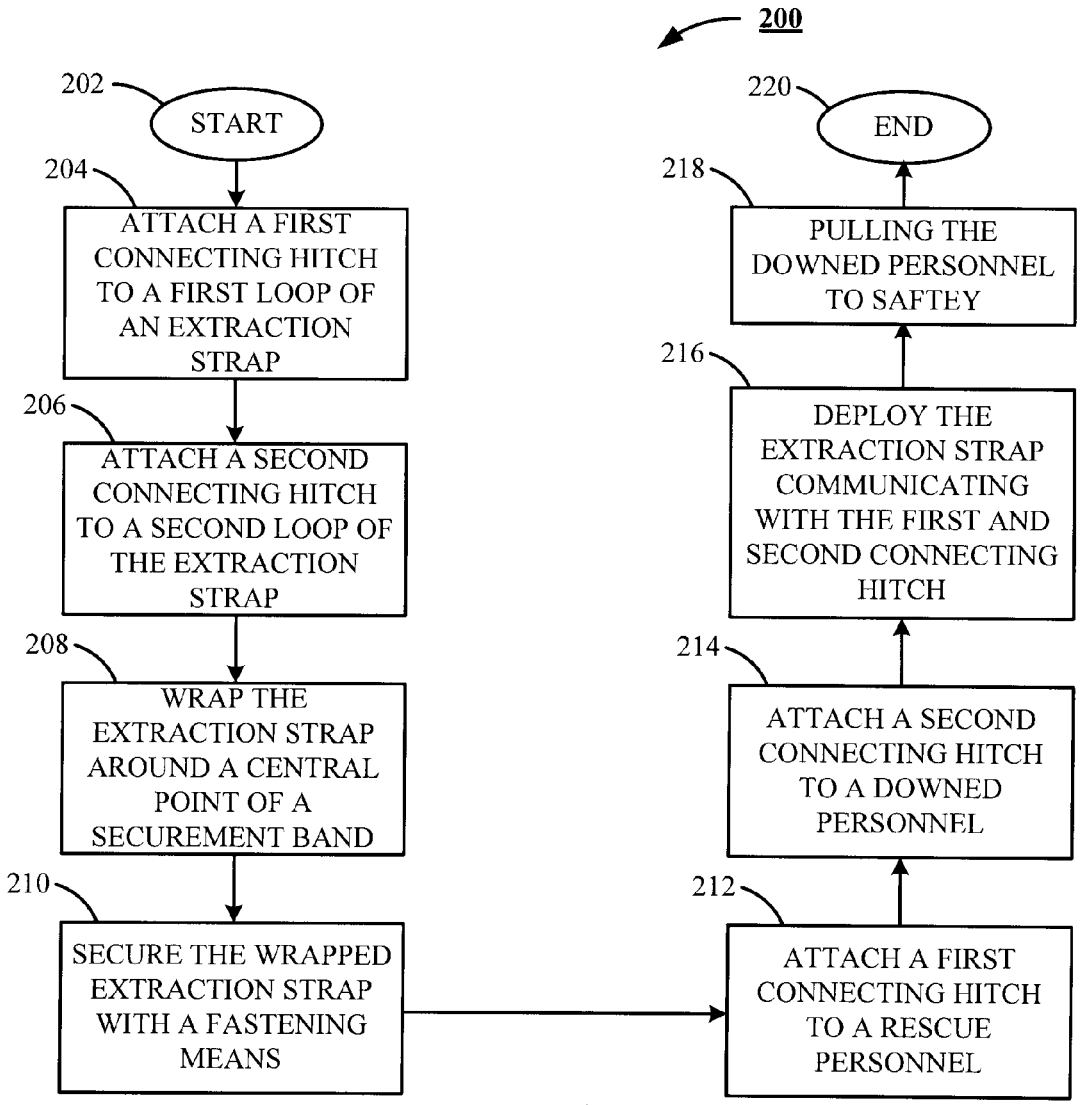
FIG. 8 is a flow chart of a method of using an embodiment of a personnel extraction system in a preferred embodiment.

FIG. 8 shows a preferred method 200 of assembling an embodiment of a personnel extraction system of the present inventive subject matter commencing at start step 202, and continuing at process step 204. At process step 204, a first connecting hitch (such as 114) is attached to a first loop (such as 112) of an extraction strap (such as 110). At process step 206, a second connecting hitch (such as 114) is attached to a second loop (such as 112) of the extraction strap, wherein the first and second loops are preferably provided at opposite ends of the extraction strap. At process step 208, the extraction strap is wrapper around a central point of a securement band (such as 102), and at process step 210, the wrapped extraction strap is secured and confined by the securement band through use of fastening means, which are preferably, but not limited to, a hook and loop fastening system. At process step 212, the first connecting hitch is attached to a rescue personnel, while at process step 214 the second connecting hitch is attached to a downed personnel.

At process step 216, the extraction strap is deployed, the extraction strap is attached to and disposed between the first an second connecting hitches. At process step 218, the downed personnel is pulled to safety by the rescue personnel, and the process concludes at end process step 220.

As will be apparent to those skilled in the art, a number of modifications could be made to the preferred embodiments which would not depart from the spirit or the scope of the present invention. While the presently preferred embodiments have been described for purposes of this disclosure, numerous changes and modifications will be apparent to those skilled in the art. Insofar as these changes and modifications are within the purview of the appended claims, they are to be considered as part of the present invention.

What is claimed is:

1. A method by steps comprising:

securing a first connecting hitch of a personnel extraction system to a rescue personnel;

attaching a second connecting hitch of the personnel extraction system to a downed personnel;

releasing a securement band, said securement band enclosing a central portion only of a coiled extraction strap within the confines of the securement band, the securement band affixed to the extraction strap;

deploying said extraction strap while the securement band continues to enclose the central portion only of the coiled extraction strap, said extraction strap communicating with and disposed between the first and second connecting hitches; and pulling the downed personnel to safety, wherein said coiled extraction strap includes a non-central portion that extends beyond the confines of the securement band.

2. The method of claim 1, by steps further comprising:

wrapping the extraction strap around a central point of the securement band; and confining the wrapped extraction strap within the securement band via a fastening means provided by the securement band.

3. The method of claim 2, in which the extraction strap provides a first attachment loop on a proximal end of the extraction strap.

4. The method of claim 3, in which the extraction strap provides a second attachment loop on a distal end of the extraction strap.

5. The method of claim 4, in which the first connecting hitch communicates with the first attachment loop.

6. The method of claim 5, in which the second connecting hitch communicates with the second attachment loop.

7. The method of claim 6, in which the first connecting hitch is a first carabiner.

8. The method of claim 7, in which the second connecting hitch is a second carabiner.

9. The method of claim 8, in which the fastening means comprises a hook and loop fastening combination.

* * * * *